US007644981B2

(12) United States Patent
Hensley

(10) Patent No.: US 7,644,981 B2
(45) Date of Patent: Jan. 12, 2010

(54) COLLAPSIBLE AND PORTABLE CHAIR

(76) Inventor: Fred Hensley, 2317 Great Bear La., Denton, TX (US) 76210

( * ) Notice: Subject to any disclaimer, the term of this patent is extended or adjusted under 35 U.S.C. 154(b) by 0 days.

(21) Appl. No.: 12/103,305

(22) Filed: Apr. 15, 2008

(65) Prior Publication Data

US 2009/0256401 A1 Oct. 15, 2009

(51) Int. Cl.
*A47C 4/00* (2006.01)

(52) U.S. Cl. ..... 297/17; 297/4; 297/35; 297/53; 297/56; 297/129; 297/183.6; 297/188.04

(58) Field of Classification Search ..... 297/4, 297/17, 21, 35, 40, 52–53, 56, 129–130, 297/183.2, 183.6, 188.01, 188.04, 188.08
See application file for complete search history.

(56) References Cited

U.S. PATENT DOCUMENTS

| | | | | |
|---|---|---|---|---|
| 1,615,159 | A | 1/1927 | Bonner | |
| 2,375,819 | A | 5/1945 | Reid | |
| 2,843,185 | A | 7/1958 | Clem et al. | |
| 2,922,465 | A * | 1/1960 | Johansson et al. | 224/155 |
| 4,387,924 | A | 6/1983 | Fernandez | |
| 4,773,574 | A * | 9/1988 | Burgard | 224/155 |
| 4,824,167 | A * | 4/1989 | King | 297/129 |
| 5,244,250 | A | 9/1993 | Nordmeyer | |
| 5,499,860 | A | 3/1996 | Smith et al. | |
| 5,507,508 | A * | 4/1996 | Liang | 280/37 |
| 5,573,288 | A | 11/1996 | Raffensperger | |
| 5,620,227 | A | 4/1997 | Brune | |
| 5,779,112 | A * | 7/1998 | Krulik | 224/155 |
| 5,819,999 | A * | 10/1998 | Tennant | 224/155 |
| 5,927,798 | A * | 7/1999 | Ahn | 297/129 |
| 5,957,349 | A * | 9/1999 | Krulik | 224/155 |
| 6,048,023 | A * | 4/2000 | Lampton | 297/129 |
| 6,217,113 | B1 * | 4/2001 | Knatz | 297/118 |
| 6,347,406 | B1 * | 2/2002 | Jones et al. | 2/69 |
| 6,547,324 | B1 * | 4/2003 | Ammann, Jr. | 297/129 |
| 6,644,447 | B2 * | 11/2003 | Pohl | 190/8 |
| 6,997,507 | B2 * | 2/2006 | Rhee | 297/129 |
| 7,118,172 | B1 * | 10/2006 | Pattison-Sheets | 297/129 |
| 7,354,049 | B2 * | 4/2008 | Schmidt | 280/33.993 |
| 2007/0018491 | A1 | 1/2007 | Jones | |

* cited by examiner

*Primary Examiner*—Laurie K Cranmer
(74) *Attorney, Agent, or Firm*—Colin P. Cahoon; Bobby W. Braxton; Carstens & Cahoon, LLP

(57) ABSTRACT

A portable two-frame collapsible chair comprised of an inner and outer frame with the frames hingably joined for rotating between a first position for carrying and a second position for sitting. The chair includes a flexible seat member connected to both frames. The chair further includes a flexible backrest hingably connected to the outer frame with optional armrests hingably attached. The frames can be folded into substantially the same plane when in the first position for carrying. The position for carrying includes a variety of configurations including a backpack configuration, wherein the user uses shoulder straps to carry the chair, and a roller bag configuration wherein the chair has wheels and a pull handle.

20 Claims, 3 Drawing Sheets

COLLAPSIBLE AND PORTABLE CHAIR

BACKGROUND OF THE INVENTION

1. Technical Field

This invention relates to a two frame collapsible chair which can be folded into a transport configuration.

2. Description of Related Art

When participating in activities such as fishing, hunting, and attending sporting events such as youth soccer or baseball, it is desirable to have a portable folding chair that is easy to carry. In addition, it is desirable or necessary to carry other items such as drinks, food, sunscreen and other various sundries.

Folding chairs currently on the market and commonly used tend to be heavy and cumbersome to carry and many fold up and must be placed into a bag for carrying. Others that fold the seat to the back tend to unfold while in transport and their size and weight make them difficult for adults short in stature or children to carry. Further, carrying other items or tending to small children or pets is difficult with only one available arm.

Many people choose to wear a backpack to carry the various items needed for the activity and then carry their chair in one hand. Again, the difficulties mentioned previously still exist and when arriving at their destination, the user now has two separate items to care for.

Several examples of prior art exist to address the idea of carrying a fold up chair on one's back in combination with a backpack. However, such prior art tends to be heavy, cumbersome and unstable when unfolded. In addition, the prior art is large when folded which increases shipping costs to retailers and takes up valuable retail shelf space as well as storage space for the end user. An example of such a product is disclosed in Amman U.S. Pat. No. 6,547,324B1, hereinafter "Amman", which discloses a three frame chair having the backpack portion mounted on the backrest. The Amman chair suffers from several disadvantages. First, no provision exists for holding the backrest in the upright position when no one is sitting in the chair. If the chair is sitting on an un-level surface, which will be common in its intended use, the backrest will fall over onto the seat when the user stands up. Second, the lower frame does not extend below the center of gravity of the backpack itself. If the backpack has much weight in it, the chair will tip over backwards when first opened or when the user stands up. Third, no provision exists to adjust the angle of the backrest without also affecting the seat height. The backrest can be adjusted but the action requires that the seat height be lowered disproportionately. Further, the structure requires the use of three frames that do not fold into the same plane, which takes up more space and presents storage and shipping problems as noted above. As those skilled in the art will appreciate, an additional frame adds to the cost of manufacturing both in labor and raw materials required. Consequently, it is desirable to have a chair which can be manufactured with decreased raw material and labor costs.

Additionally with the chair in Amman, when in the folded position and carried on one's back, the frames are in direct contact with the user's back and the weight of the chair and backpack load are concentrated in small areas of the user's back. While foam padding can be employed on the frame, such padding does not distribute the load satisfactorily, especially when the backpack is heavy and/or when traveling significant distances. Another disadvantage is that the armrests require vertical structural members attached to both of the chair frames. As discussed above, this adds to the overall weight and manufacturing costs and also reduces long term reliability. Finally, a strap and buckle arrangement is employed to hold the chair in the folded position for wearing on one's back. Because the shoulder straps are attached to the bottom of the seat frame, the chair would unfold while in use if the strap and buckle arrangement were to fail. These are just a few of the problems with the chair disclosed by Amman. These illustrate many of the inherent design problems which are common with other known prior art chairs. These problems limit the use and comfort of the chair, add to the weight and bulk of the chair, increase the raw material and manufacturing costs of the chair, and lead to an overall dissatisfactory solution to a common problem. Consequently, it is desirable to have a chair which is less expensive to manufacture, which is easier to carry, which has the "extras" such as a backrest and armrests, and which is more enjoyable to use.

SUMMARY

The invention comprises a two-frame collapsible chair. The chair comprises two frames hingably joined for rotating between a first closed position for transporting and a second position for sitting. The chair has a seat member and a backrest. Some embodiments also comprise arm rests attached to the backrest.

The chair has at least one storage panel which is attached to at least one set of frames. The storage panel can comprise a variety of storage means including a backpack, a briefcase, a laptop carrier, and a panel with a plurality of storage pockets.

The chair also has a variety of transport configurations. One configuration is the backpack configuration wherein straps are attached to at least one frame of the chair. In such a configuration, the user carries the chair like a backpack with shoulder straps attached to the frame. In another configuration, the chair has wheels attached to at least one frame. In such a roller bag configuration, the user can pull the chair in its transport configuration.

BRIEF DESCRIPTION OF THE DRAWING

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures.

Figure 1:
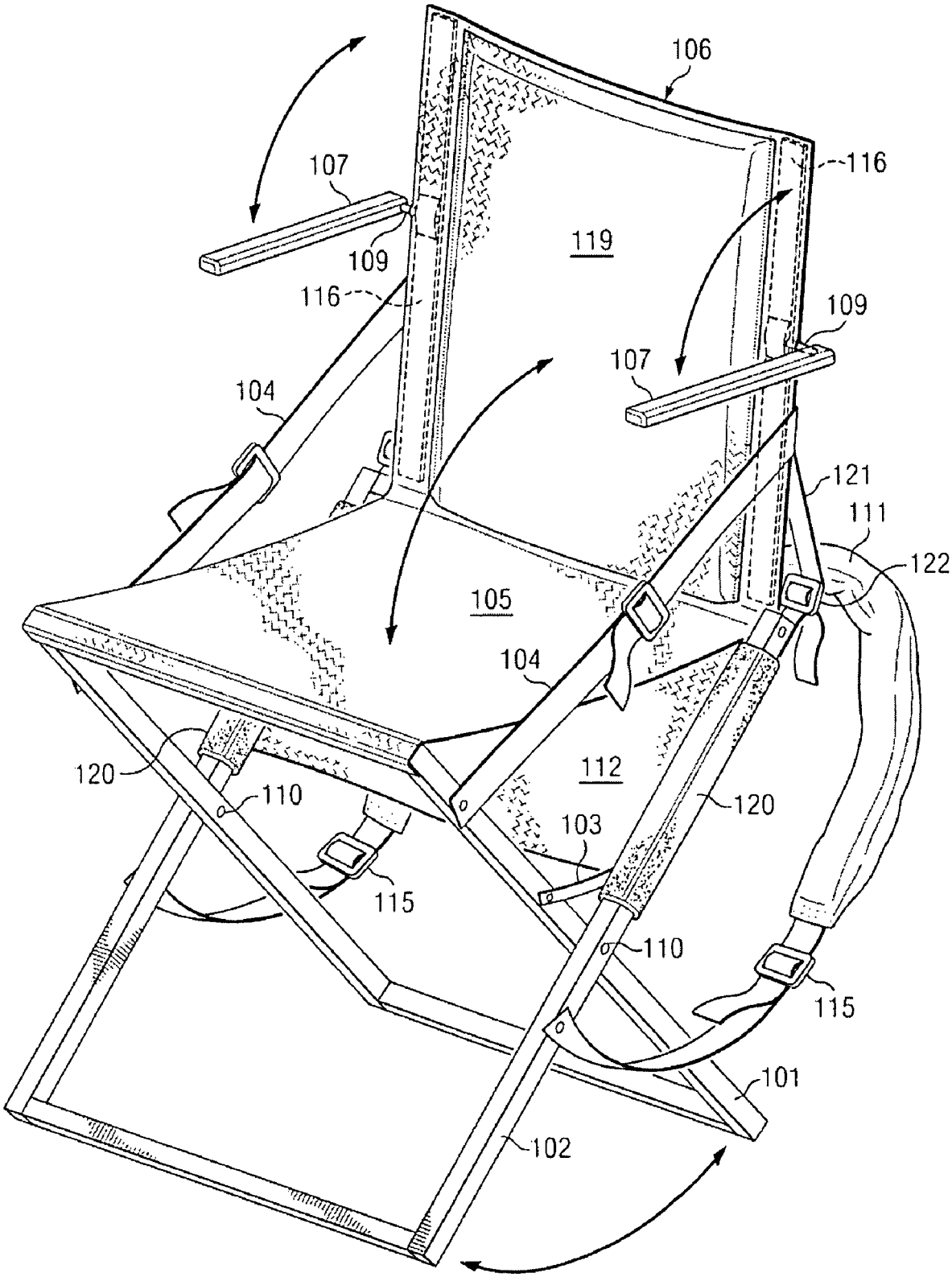
FIG. 1 depicts a perspective view of one embodiment of the chair in its use configuration.

As will be discussed, the two-frame collapsible chair has two configurations: a first closed position for transport, and a second open position for sitting. FIG. 1 depicts a perspective view of one embodiment of the chair in its use configuration. The device is a two-frame collapsible chair comprised of an inner frame 101 that is hingably joined to an outer frame 102 by means of a bolt, rivet or shear pin 110 that allows rotation about a plane. As used herein, "two-frame" refers to a chair which comprises only two frames. This is contrasted to three-frame chairs known in the art. As discussed herein, a two-frame structure offers many benefits over a three-frame structure including cost of manufacture, weight, and portability.

The frames 101, 102 are made of steel, aluminum, plastic, or other rigid materials. In one embodiment, one or both frames 101,102 are padded (120) which provide additional comfort to the user when used in its backpack transport configuration. The frames 101, 102 can have virtually any cross-sectional geometry including but not limited to square, rectangular, and circular cross-sections. The inner frame 101 is narrower and shorter than the outer frame 102. In a preferred embodiment, the inner frame 101 has a length of about 80% to about 95% of the outer frame 102. In a more preferred embodiment, the inner frame 101 has a length of about 92% of the outer frame 102. It should be noted that in a preferred embodiment the frames 101,102 when in the closed position are separated by minimal distance. In many embodiments, this distance or "tolerance" is on the order of several millimeters. Thus, when in the closed position, the two frames are separated by a very short distance and fine tolerance. This line tolerance adds structural support and durability to the chair. However, the tolerance is designed so that the functionality of the chair is not impaired. It should be noted that in some embodiments, the tolerance between the closed frames 101, 102 is increased to make room for devices such as an over-center locking device 103 which will be discussed below.

Additionally, in a preferred embodiment, each frame 101, 102 is a single piece. As used herein a "single piece" includes pieces which have been made as a single piece, i.e. cast as one piece, as well as individual pieces which have been welded or chemically or mechanically secured. Because each frame 101,102 is a single piece, the stability of the chair in both its use and transport configuration is increased.

In one embodiment the outer frame 102, a connected frame, serves as the front base of the chair, as opposed to open legs. Such an embodiment helps secure the chair in its use configuration. A chair with individual legs tends to sink into the ground, destabilizing the chair. The instant invention offers a connected frame whereby the front base comprises a length of structure as opposed to individual legs. The same is true for the back base. Again, such a configuration prevents the chair from sinking into the ground because the weight of the chair is distributed across the length of the back base and the front base. For these reasons, in a preferred embodiment the frame's horizontal members and the vertical members align such that neither sticks out beyond the boundaries of the frames 101,102. This prevents a portion of the frame, for example, a vertical member, from jetting out and acting as an individual leg. It should be noted that while an embodiment comprising a connected frame whereby the frame does not comprise legs, the instant invention is not so limited. In other embodiments, it is preferable that the bottom of each of the frames 101,102 comprise individual legs rather than the connected length of structure as depicted. Furthermore, in some embodiments it is desirable to have one frame comprise legs at the bottom while the other frame comprises a connected length of structure.

When collapsed in the first closed position for transporting, the inner frame 101 and the outer frame 102 are substantially in the same plane. This is beneficial for many reasons. First, because the two frames are in the same plane they take up less space on the retailer's shelves as they are more compact. Likewise, when shipping they take up less space in a shipping truck, for example. These factors decrease manufacturing costs and allow for the production of a less expensive chair. Second, the two frames 101, 102 when in the transport configuration are more stable than prior art chairs wherein the frames were not in the same plane. Because the frame of the transport configuration is more stable, the chances of it collapsing into the use configuration are considerably reduced. Further, because the frames 101,102 are more compact, this increases the space available for other items stored in the chair, for example, in the storage panel 112.

The frames 101,102, as depicted, are connected by a pivot 110. In one embodiment, the pivot 110 employs a spacer and/or bushings to allow for ease of movement. The pivot 110 can include any hinging material known in the art including a pin. In the depicted embodiment, the frames 101,102 when rotated to the open position are secured in the open position by an over-center locking device 103. In one embodiment, the over-center locking device 103 is a metal hinge which is coupled to both frames 101,102. The locking device 103 can serve a plurality of purposes. First, the locking device 103 locks the frames in place so that the frames cannot collapse when in the use position without adjusting the locking device 103. Second, the locking device 103 defines the maximum distance the frames 101,102 can be separated. This keeps the chair in the desired position. Additionally, in some embodiments this alleviates pressure on the flexible seat member 105, ensuring it is not stretched beyond its breaking point.

The flexible seat member 105 is made of canvas or other similar material and is attached to the outer frame 102 and the inner frame 101 using screws, rivets, sewing, or other similar methods known in the art. When in the open and locked position, flexible seat member 105 is stretched tight forming an upward facing seat panel.

In a preferred embodiment, the chair further comprises a flexible backrest 106. It should be noted that some embodiments, for example, in some embodiments of the roller bag configuration, the chair does not employ a backrest 106. The flexible backrest 106 has a back side and a front side which will touch the user's back when in the second sitting position.

The flexible backrest 106, typically made with similar material as the seat member 105, is attached to the top of the outer frame 102 using screws, rivets, sewing, etc., and is affixed in such a way that its flexibility acts as a hinge, allowing it to pivot back. In a preferred embodiment the flexible backrest 106 material covers the top of the outer frame 102 so that when a user sits in the chair the user does not sit directly on the outer frame 102. Such an embodiment allows for increased comfort. For example, if the outer frame 102 is metallic, then the frame can become undesirably hot during the heat and undesirable cold during the winter, decreasing the overall comfort of the chair. Additionally, in one embodiment the backrest (106) comprises cushions (119) which offer additional support and comfort in both the sitting configuration as well as the transport configuration.

When opened and in use the back side of the backrest 106 can be used to display logos for the invention itself or other advertisements such as team logos or corporate promotions. In one embodiment, the angle of backrest 106 is secured and adjusted using front support straps 104 which are affixed to the inner frame 101 using screws, rivets, or the like. The front support straps 104 are also attached to the backrest 106 by screws, rivets, sewing, etc. In one embodiment, the front support straps 104 are attached to the front of the inner frame 101 as opposed to the side as depicted in FIG. 1. Such an embodiment allows for easier collapsing of the chair as the strap 104 and its securing means do not interfere with the collapsing as they are not located in between the two frames 101, 102.

The backrest 106 has stiffeners 116 made of plastic, steel, aluminum, or other rigid materials, that are sewn in or otherwise secured to provide additional Support to the user's back.

In one embodiment, when in the second open position, the bottom of each stiffener 116 rests on the top of outer frame 102 and such interface forms a fulcrum to further provide rigidity to the users back. It should be noted, however, that the stiffeners 116 are not separately attached to either frame. Thus, while the stiffeners 116 offer additional back support, they are not attached to the frame 102. Instead, they are attached and secured to the backrest 106, which as described above, is hingably attached to the outer frame 102. In one embodiment the stiffeners 116 are surrounded by the fabric of the backrest 106 so that the stiffeners 116 are not visible to the user. Again, because the stiffeners 116 are not themselves attached to the outer frame 102, they are not considered an additional frame. Instead, the stiffeners 116 simply offer additional support to the backrest 106.

In a preferred embodiment, the chair further comprises optional arm rests 107. The arm rests 107 are made from a variety of materials including plastic, wood, metal, etc. Additionally, the arm rests 107 may comprise padding or other features such as cup holders. The arm rests 107 can be secured in many ways. In one embodiment the stiffeners have pivot rods 109 attached and which protrude from the backrest 106. The armrests 107 are hingably attached to pivot rods 109. The armrests 107 are supported in the down position by a cam and pin arrangement, adjustable straps attached to the backrest 106, or other means. In another embodiment the arm rests are secured at one end to the backrest 106 and are supported at the other end of the arm rest 107 by adjustable straps also attached to the backrest 106. Those skilled in the art will appreciate other ways of securing arm rests which are within the scope of this invention.

In one embodiment, when the flexible backrest 106 is in the up position it is held in such position by a back support strap or straps (121) that are attached to the back of the top portion of the outer frame 102. The back support straps (121) are also connected to the back lower portion of the flexible backrest 106 by means of a buckle (122), snap or hook and loop material. Said back support straps (121) prevent the flexible backrest 106 from folding over when the seat is not occupied. This is an improvement over prior art chairs wherein the backrest fell whenever the occupant stood. As can be appreciated, when attending a soccer game, for example, the occupant may stand and sit several times in a game. Constantly having to lift up the backrest can become very frustrating. Thus, in one embodiment the backrest 106 is supported in the front and back by straps which prevent the backrest 106 from tipping forward or backward.

The instant invention provides for several embodiments of the transport configuration. For example, in one embodiment the transport configuration comprises a backpack whereas another comprises a rolling bag.

To close the chair and prepare it for transport the armrests 107 are folded up into the same plane as flexible backrest 106. The straps holding flexible backrest 106 in the upright position are released, allowing it to fold down flat against flexible seat member 105. The over-center locking devices 103 are released and inner frame 101 rotates until it is in substantially the same plane as outer frame 102. The flexible seat member 105 automatically folds and hangs below the frames 101,102 and the flexible backrest 106 then hinges over and hangs in front of the folded frames 101,102.

In the backpack transport configuration, to transport the user can employ the use of shoulder straps 111 which are preferably adjustable in length by adjusters 115. A user can then carry the chair like a typical backpack wherein the load is supported by shoulder straps. The shoulder straps 11 may be attached to either frame, but in a preferred embodiment, the shoulder straps are attached to the upper center of outer frame 102 by screws or rivets and the lower outer portion of outer frame 102 by screws or rivets. In this carrying position the flexible backrest 106 forms a pad to cushion the user's back from the forces imposed by the weight of the chair. Thus, while carrying, the back side of the backrest 106 is positioned against the carrier's back. As discussed previously, in one embodiment the backrest 106 is cushioned which provides extra comfort to the user. The shoulder straps 111 upper attachment locations maintain a force upon the frame which prevents the chair from folding open while being carried by said straps 111. This is another improvement over prior art chairs. Because the straps 111 are attached to the outer frame 102, and because the inner frame 101 pivots outward in the same direction where the carrier is located, the carrier of the pack is in the way and the chair is prohibited from opening. Further, even if the pack is not carried by the shoulder straps 111 but instead by a carrying handle 114 secured to the outer frame 102 (depicted in FIG. 2), the chair is prohibited from opening because the backrest 106 prohibits the inner frame 101 from pivoting open.

Still referring to FIG. 1, the backside of the storage panel 112 is visible. Because the outer frame 102 is at an angle, the storage panel 112 is also at an angle. When in the unfolded position the storage panel 112, as depicted, is located beneath the flexible backrest 106 and it is easily accessed by users sitting the seat. The location places the weight of the storage panel and its contents inside the envelope formed by the seat frames 101, 102 which prevents the chair from falling over when in the open position. Despite the angle of incline, the goods located in the panel 112 are secure. A better description of the storage panel 112 can be found by referring to FIG. 2.

Figure 2:
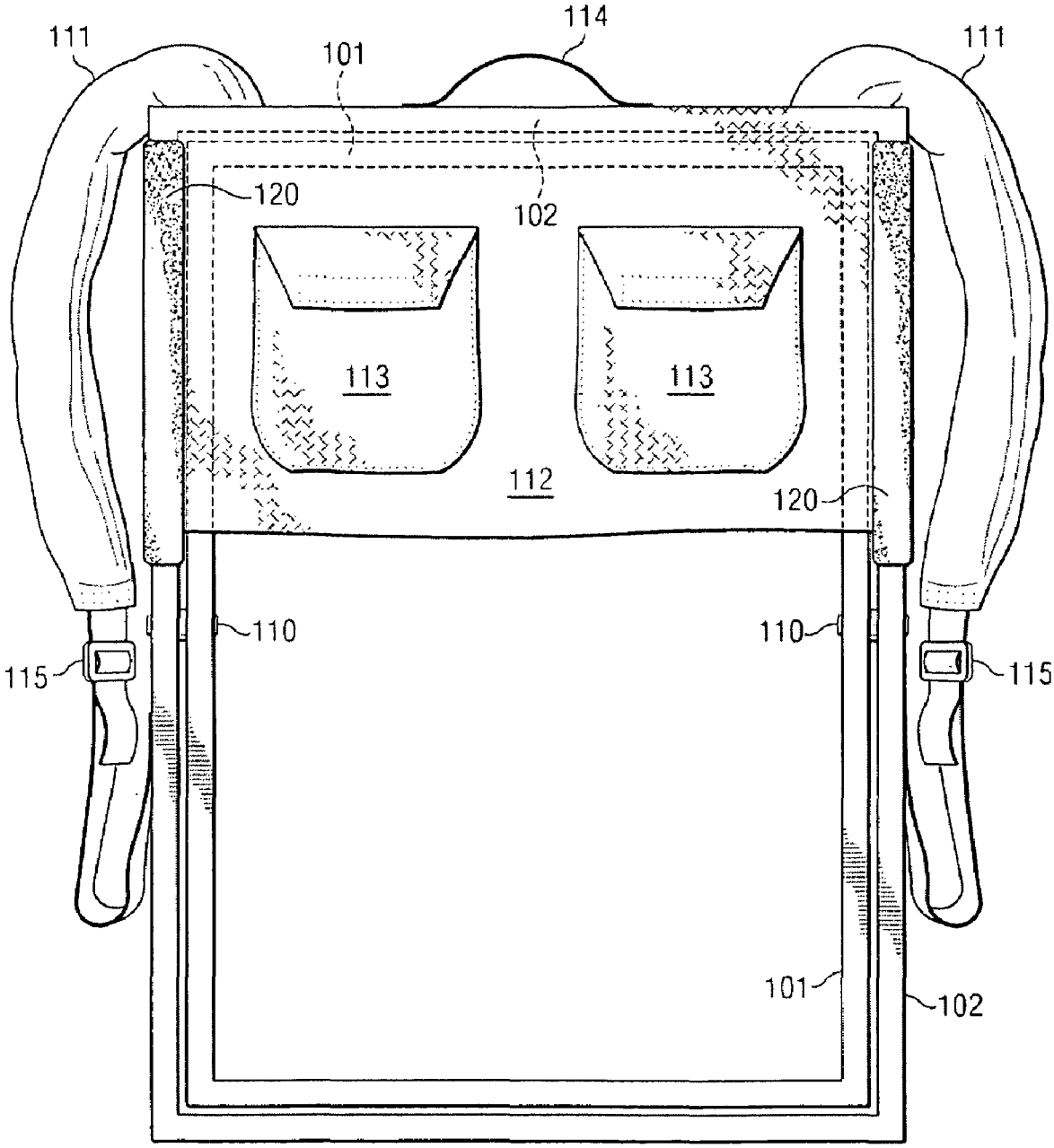
FIG. 2 depicts a back view of one embodiment of the chair in its backpack transport configuration.

FIG. 2 depicts a back view of one embodiment of the chair in its backpack transport configuration. As can be seen, in the folded position the chair can also be carried or hung for storage using the carrying handle 114. FIG. 2 also illustrates the storage panel 112. In one embodiment, the chair comprises at least one storage panel 112 attached to at least one of the frames 101,102. The storage panel 112 depicted is attached to the back of outer frame 102, but as described below the location and number of the storage panels 112 can vary. In the embodiment depicted, the storage panel 112 employs two pockets 113. Other embodiments may employ pockets 113 of varying sizes, shapes, and number. For example, the pockets 113 can be insulated pockets for hot or cold food/drinks or comprise a bladder with an optional drinking tube for carrying drinking liquids. Open areas of the storage panel 112 can be used to display logos for the invention itself or other advertisements such as team logos or corporate promotions. In other embodiments the storage panel 112 comprises a traditional backpack which may have additional pockets. Thus, the backpack may contain one or more large volume compartments internally and one or more external pockets. Finally, the storage panel 112 may comprise a briefcase, laptop carrier, or a panel comprising assorted pockets. Those skilled in the art will appreciate other storing means which are within the scope of the instant invention.

Figure 3:
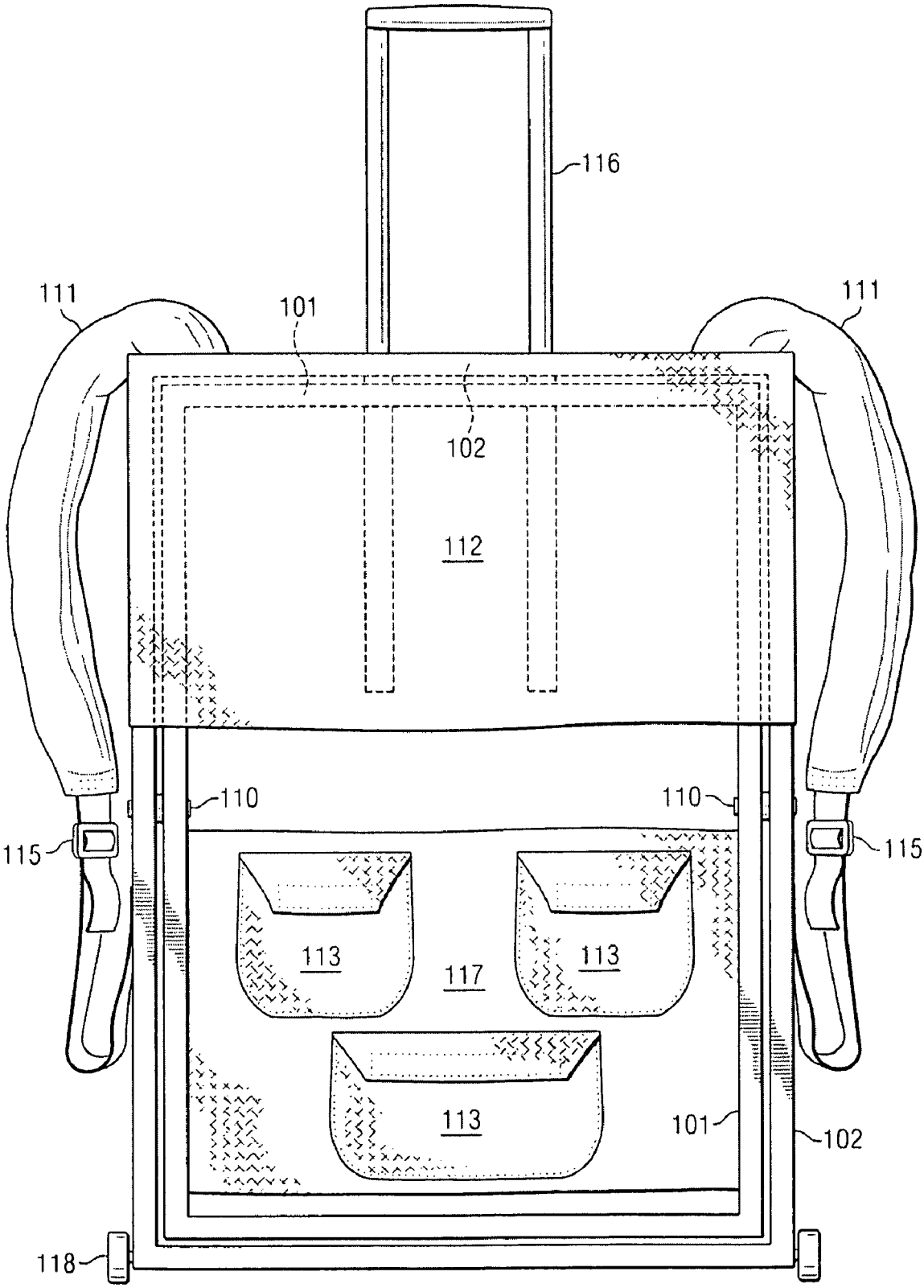
FIG. 3 depicts a back view of one embodiment of the chair in its roller bag transport configuration.

Referring now to FIG. 3, FIG. 3 depicts a back view of one embodiment of the chair in its roller bag transport configuration. A roller bag configuration is ideal for the traveling business person but is suitable for any person who finds it necessary to carry items and occasionally sit. For example, a business person often must carry a laptop, a briefcase, and the required flight documents. Because the airport is often busy, many times there is not an open seat available. Consequently, the business person is forced to stand and hold all of his or her belongings. However, the roller bag offers storage which can store the briefcase, laptop, and flight documentation. Further, because the roller bag is also a chair, the user can also sit in the chair. Finally, in one embodiment the roller bag is sized to be carried onto the airplane.

The chair in its roller bag transport configuration works the same as the chair described above herein. However, rather than being carried as a backpack, the chair is designed to be pulled as a roller bag. Accordingly, at least one of the frames 101,102 further comprises wheels 118. The wheels 118 can be made of virtually any material, including but not limit to plastic, wood, and metal. In a preferred embodiment, the wheels 118 are sized and placed in such a fashion so as to not interfere with the chair in its use configuration. Thus, when in a chair configuration, the wheels 118 do not touch the ground. Those skilled in the art can easily determine ideal placement of the wheels 118. For example, in one embodiment the wheels 118 are placed so that the lower portion of the wheel 118 is above the lowest portion of the outer frame 102. In such an embodiment, the wheels 118 are not engaged unless the roller bag is tilted at a specified angle.

The chair in its roller bag configuration also comprises a pulling handle 116. Such a handle 116 allows the user to more easily roll the bag. In a preferred embodiment, the handle 116 is extendable to a height that a user can easily grab the handle and walk comfortably. The extendable handle 116, when not in use is pushed back into the storage panel 112 for storage. In a preferred embodiment, the pulling handle 116 is secured between the storage panel 112 and said frames 101,102. The storage panel 112 depicted is attached to the outer frame 102 and does not interfere with the opening and closing of the chair. The storage panel 112 can comprise the same embodiments as discussed above including pockets, backpack, briefcase, or laptop carrier.

In the depicted embodiment, a second storage panel 117 is located on the inner frame 101 below the pivot 110. Because the bottom of the inner frame 101 pivots upward (when viewed in FIG. 3), such a location will not hinder the operation of the chair. Similar variations of the storage panel 112, including pockets and backpacks may similarly be employed. Thus, a user of the depicted chair can store a laptop in the first storage panel 112 and a briefcase in the second storage panel 117. Referring back to FIG. 1, it can be appreciated that if such a second-lower storage panel 117 were employed, it would be located at the bottom of inner frame 101 and would, like the first storage panel 112, have an angle of inclination. In some embodiments it may be desirable to only have one storage panel and in other embodiments it may be desirable to have two. The second storage panel 117, while only depicted in the roller bag configuration, can also be used in the backpack configuration.

While not depicted, it should be noted that some embodiments the chair can be operated as a roller bag and a backpack. For example, in one embodiment the chair in the roller bag configuration comprises shoulder straps (111). In such an embodiment, a user can utilize the chair's wheels and roll the chair in the roller bag configuration. However, upon encountering rough terrain, the user can employ the chair's shoulder straps (111) and carry the chair in its backpack configuration.

While the invention has been particularly shown and described with reference to a preferred embodiment, it will be understood by those skilled in the art that various changes in form and detail may be made therein without departing from the spirit and scope of the invention.

What is claimed is:

1. A two-frame collapsible chair comprising:

an inner frame and an outer frame, said frames hingably joined for rotating between a first closed position for transporting and a second open position for sitting;

a flexible seat member connected to both of said frames;

a flexible backrest comprising a front side and a back side, said flexible backrest being hingably connected to said outer frame, said flexible backrest further comprising a front support strap coupled to said inner frame;

at least one storage panel attached to one of said frames;

wherein said inner and outer frames are in the same plane when in the first position for transport; and wherein said outer frame is longer and wider than said inner frame.

2. The collapsible chair of claim 1 wherein said backrest further comprises a back support strap.

3. The collapsible chair of claim 1 wherein said backrest further comprises stiffeners.

4. The collapsible chair of claim 1 wherein at least one of said at least one storage panel is attached to said outer frame.

5. The collapsible chair of claim 1 wherein at least one of said storage panel is attached to said inner frame.

6. The collapsible chair of claim 1 further comprising:

a first storage panel attached to said outer frame;

a second storage panel attached to said inner frame;

wherein said second storage panel is located below said first storage panel.

7. The collapsible chair of claim 1 wherein said at least one storage panel comprises a storage means selected from the group consisting of: backpack, briefcase, laptop carrier, and a panel comprising assorted pockets.

8. The collapsible chair of claim 1 further comprising an arm rest connected to said backrest.

9. The collapsible chair of claim 8 wherein said arm rest is attached to a pivot rod which is attached to and protrudes from the backrest.

10. The collapsible chair of claim 1 further comprising shoulder straps attached to one of said frames, whereby when in said first position for transporting a user can use said collapsible chair as a backpack.

11. The collapsible chair of claim 10 wherein when a user uses said backpack, the user's back will be against the back side of the backrest.

12. The collapsible chair of claim 10 wherein said shoulder straps are attached to said outer frame.

13. The collapsible chair of claim 10 wherein said backrest is cushioned.

14. The collapsible chair of claim 10 wherein said outer frame comprises padding.

15. The collapsible chair of claim 10 further comprising a carrying handle secured to said outer frame.

16. The collapsible chair of claim 1 further comprising:

wheels located on at least one of said frames; and a pulling handle secured to said chair;

whereby when in said first position for transporting a user can use the collapsible chair as a roller bag.

17. The collapsible chair of claim 16 wherein said wheels are attached to said outer frame.

18. The collapsible chair of claim 16 wherein said pulling handle is extendable.

19. The collapsible chair of claim 16 wherein said pulling handle is secured between said at least one storage panel and said frames.

20. The collapsible chair of claim 16 further comprising shoulder straps attached to one of said frames.

* * * * *